US008224210B2

(12) United States Patent
Levintant et al.

(10) Patent No.: US 8,224,210 B2
(45) Date of Patent: Jul. 17, 2012

(54) IMAGE DEVELOPER FOR PRESENTING INK TO A PHOTOCONDUCTOR

(75) Inventors: Oran Levintant, Rehovot (IL); Shachar Berger, Taimei-Yehiel (IL); Forest Patton, San Diego, CA (US); John W. Godden, San Diego, CA (US); Christian Schmid, San Diego, CA (US); Amir Ofir, Yad-Binyamin (IL); Zvika Cohen, Gerat Berner (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 254 days.

(21) Appl. No.: 12/756,641

(22) Filed: Apr. 8, 2010

(65) Prior Publication Data

US 2011/0249989 A1 Oct. 13, 2011

(51) Int. Cl.
*G03G 15/10* (2006.01)

(52) U.S. Cl. ..... 399/237

(58) Field of Classification Search ..... 399/237, 399/240, 241

See application file for complete search history.

(56) References Cited

U.S. PATENT DOCUMENTS

| | | | | |
|---|---|---|---|---|
| 5,610,694 | A * | 3/1997 | Lior et al. | 399/240 |
| 2003/0133725 | A1 * | 7/2003 | Park et al. | 399/237 |
| 2007/0231013 | A1 * | 10/2007 | Hasdai et al. | 399/241 |
| 2010/0054777 | A1 * | 3/2010 | Mao | 399/53 |

* cited by examiner

*Primary Examiner* — Quana M Grainger

(57) ABSTRACT

In one embodiment, an image developer includes a developer roller rotatable along a photoconductor for presenting a layer of ink to the photoconductor and a cleaner for cleaning ink from the developer roller. The cleaner includes a first cleaning roller rotatable along the developer roller for removing ink from the developer roller and a second cleaning roller rotatable against the first cleaning roller for mechanically removing ink from the first cleaning roller. In one embodiment, the second cleaning roller deforms against the first cleaning roller such that the cross-sectional length of contact between the first and second cleaning rollers is in the range of 20% to 38% of the circumference of the first cleaning roller. In one embodiment, the second cleaning roller has a density in the range of 90 kg/m$^3$ to 150 kg/m$^3$.

9 Claims, 3 Drawing Sheets

IMAGE DEVELOPER FOR PRESENTING INK TO A PHOTOCONDUCTOR

BACKGROUND

Liquid electro-photographic (LEP) printing uses a special kind of ink to form images on paper or other print medium. LEP ink, which is sometimes referred to as liquid toner, includes colorant and toner particles dispersed in a carrier liquid. The LEP printing process involves placing an electrostatic charge pattern of the desired printed image on a photoconductor and developing the image by applying a thin layer of ink to the charged photoconductor. Charged particles in the ink cause the ink to adhere to the pattern of the desired image on the photoconductor. The ink pattern is transferred from the photoconductor to an intermediate transfer member and then from the intermediate transfer member to the paper or other printable medium.

The thin layer of ink is applied to the photoconductor with a roller, typically referred to as a developer roller. The developer roller is part of a replaceable image developer unit that also includes parts that reclaim clean and reclaim residual ink from the developer roller. Residual ink is removed from the developer roller electrically using a charged cleaning roller that rotates along the developer roller. Ink is scraped off the cleaning roller with a wiper blade and, after scraping, the surface of the cleaning roller is scrubbed with a so-called "sponge" roller that rotates against the cleaning roller. The wiper blade wears down and often scratches the cleaning roller, resulting in "banding" and other defects in the printed image that ultimately lead to replacing the developer unit. The wiper's adverse affect on print quality is particularly evident in some newer inks used in LEP printers.

DESCRIPTION

A new image developer helps reduce the adverse affects of cleaning the developer roller, and thus helps prolong the useful life of the image developer in an LEP printer. The example embodiments of the new image developer described below should not be construed to limit the scope of this disclosure, which is defined in the claims that follow the description.

Figure 1:
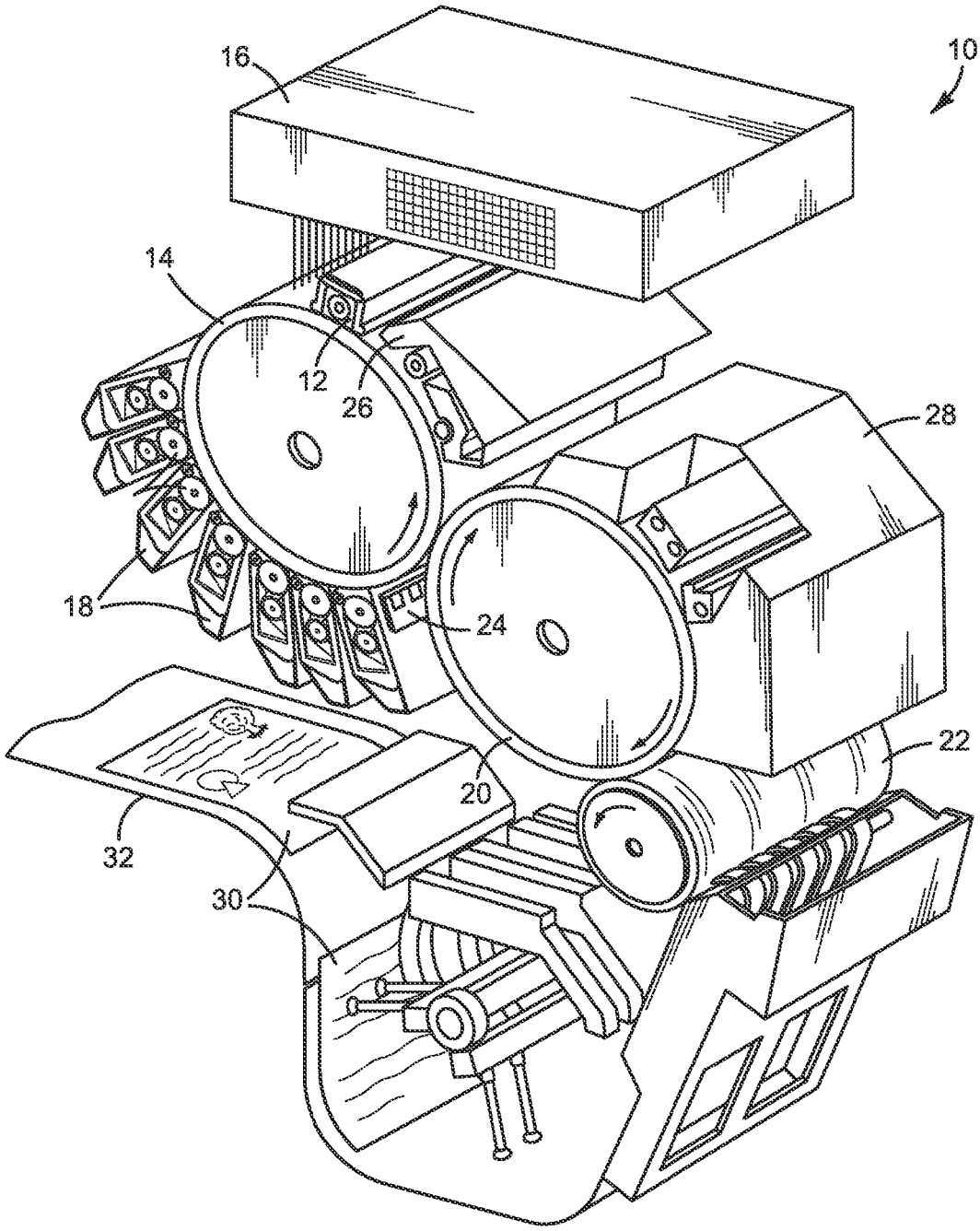
FIG. 1 illustrates one example LEP print engine in which embodiments of the new image developer may be implemented.

FIG. 1 illustrates one example an LEP print engine 10 in which embodiments of the new image developer may be implemented. Referring to FIG. 1, print engine 10 includes a scorotron or other suitable charging device 12 located adjacent to a photoconductor 14 for applying a uniform electric charge to photoconductor 14. A scanning laser or other suitable photo imager 16 exposes selected areas on photoconductor 14 to light in the pattern of the desired printed image to dissipate the charge on the areas of photoconductor 14 exposed to the light. A thin layer of ink is presented to the patterned photoconductor 14 through each of a series of image developers 18 to develop the latent image on photoconductor 14 into an ink image.

Ink is transferred from photoconductor 14 to an intermediate transfer member 20. Ink is then transferred and fused to the paper or other printable medium as the printable medium passes through the nip between intermediate transfer member 20 and a pressure roller 22. (Pressure roller 22 is often referred to as an impression cylinder.) A lamp or other suitable discharging device 24 removes residual charge from photoconductor 14. Ink residue is removed from photoconductor 14 at a cleaning station 26 in preparation for developing the next image or applying the next color plane. Volatile fumes generated as the ink carrier liquid evaporates off intermediate transfer member 20 are evacuated through a suction hood 28. Printed sheets 30 are conveyed along a discharge path 32.

Figure 2:
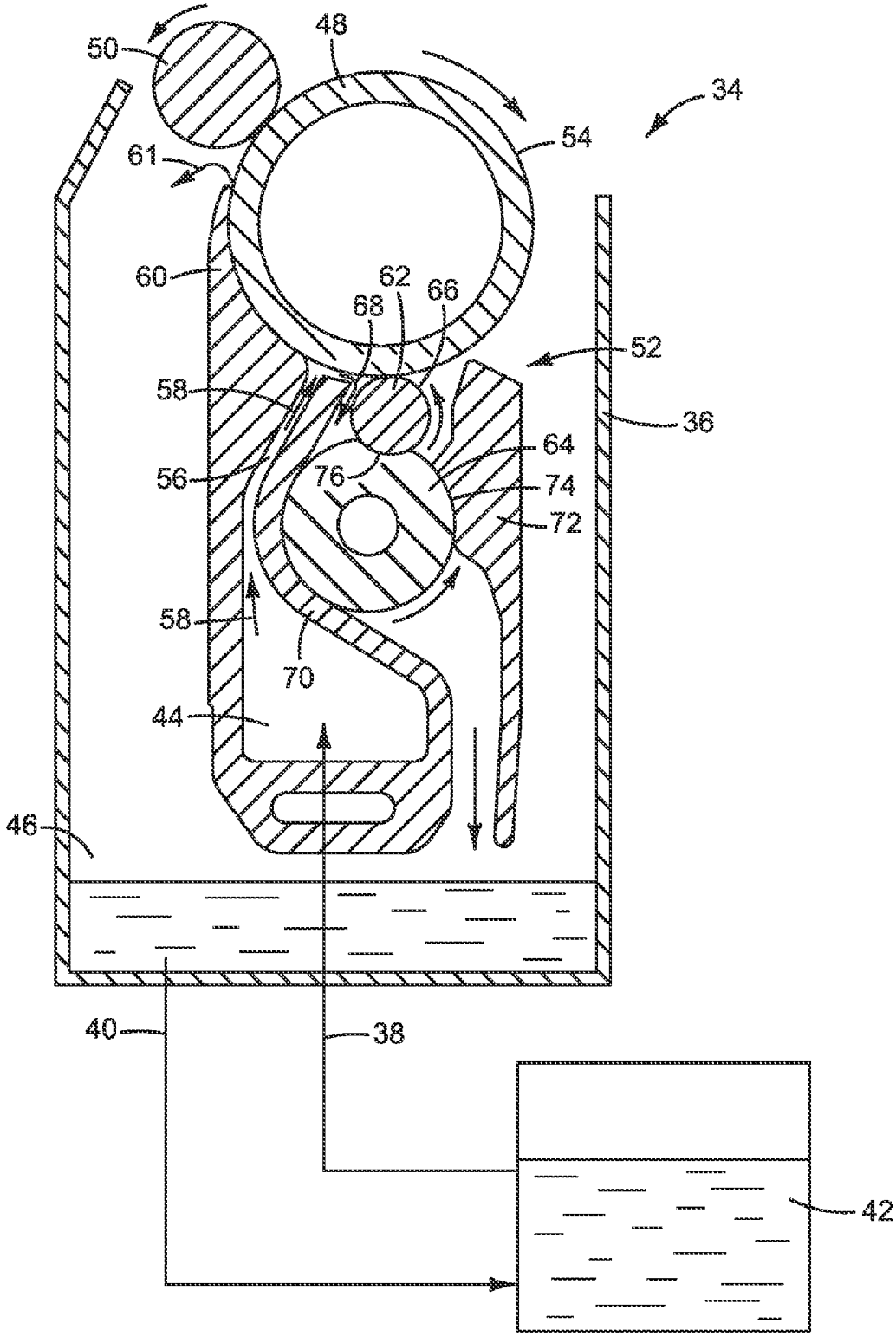
FIG. 2 illustrates one embodiment of a new image developer.

FIG. 2 illustrates one embodiment of a new image developer 34 such as may be used for each developer unit 18 in print engine 10 shown in FIG. 1. Referring to FIG. 2, developer 34 includes a housing 36 having an ink inlet 38 and an ink outlet 40, each of which is associated with an ink reservoir 42. Ink from reservoir 42 is pumped into a local supply chamber 44 in developer 34. Reclaimed ink collected in a local return chamber 46 flows to reservoir 42 through outlet 40. As described below, a developer roller 48 rotatable along a photoconductor (not shown), such as photoconductor 14 in FIG. 1, presents a thin layer of ink to the photoconductor. Image developer 34 also includes a squeegee roller 50 and a cleaner 52 for cleaning residual ink from developer roller 48.

Developer roller 48 protrudes from housing 36 such that, when image developer 34 is installed in an LEP print engine, the outer surface 54 of developer roller 48 is very close to the outer surface of the photoconductor. In operation, inlet chamber 44 is pressurized to force ink up through a channel 56 to the electrically charged surface 54 of the rotating, charged developer roller 48, as indicated by flow arrows 58. A thin layer of ink is applied electrically to roller surface 54 along an electrode 60. In one example, developer roller 48 is charged to about −450 volts and electrode 60 is charged to a much higher voltage of about −1500 volts. The large difference in voltage between electrode 60 and developer roller 48 causes charged ink particles to adhere to roller surface 54 while the generally neutral carrier liquid is largely unaffected by the voltage difference.

Squeegee roller 50 is also charged to a higher voltage than developer roller 48, about −750 volts for example. The electrically charged squeegee roller 50 rotates against the surface 54 of developer roller 48 to mechanically squeegee excess carrier liquid from the layer of ink on roller surface 54. Charged ink particles continue to adhere to the lower voltage developer roller 48. The now more concentrated layer of ink remaining on developer roller 48 is then presented to the photoconductor (not shown) where some of the ink is transferred the photoconductor to develop the latent electrostatic image on the photoconductor into an ink image. Excess carrier liquid, which may include a certain amount ink particles, drains to return chamber 46 as indicated by flow arrow 61.

Cleaner 52 includes a cleaning roller 62 and a sponge roller 64. Again, in operation, cleaning roller 62 is charged to a lower voltage than developer roller 48, about −250 volts for example. The relatively low voltage charge on cleaning roller 62 removes ink electrically from developer roller surface 54 onto the outer surface 66 of cleaning roller 62. In a conventional image developer, ink collected onto cleaning roller 62 is scraped off surface 66 with a wiper blade. However, as noted above, the wiper blade in a conventional developer can wear down and/or scratch the surface of the cleaning roller, degrading print quality. Rather than trying to optimize the wiper blade, we have discovered that it is possible to change the characteristics of the sponge roller to compensate for the absence of a wiper blade, enabling elimination of the wiper blade. Thus, in cleaner 52 ink is removed mechanically from cleaner roller 62 solely by sponge roller 64. Compared to a conventional sponge roller, the new sponge roller 64 is more dense, with a greater contact area against cleaning roller 62, as detailed below.

Sponge roller 64 rotates against cleaning roller 62 in an opposing direction to scrub ink residue from cleaning roller outer surface 66. Some of the ink residue is absorbed into sponge roller 64 and some falls away. Sponge roller 64 also absorbs some of the excess ink from the deposition region between electrode 60 and developer roller 48 which is drained along one wall 70 of inlet chamber 44, indicated at flow arrow 68. Ink is removed from sponge roller 64 through contact with chamber wall 70 and cleaner wall 72 and drains to return chamber 46, as indicated by flow arrow 73. Although a squeezer roller (not shown) may also be used, as in a conventional cleaner, to help remove ink from sponge roller 64, the characteristics of the new sponge roller 64 reduces the need for a squeezer roller.

Figure 3:
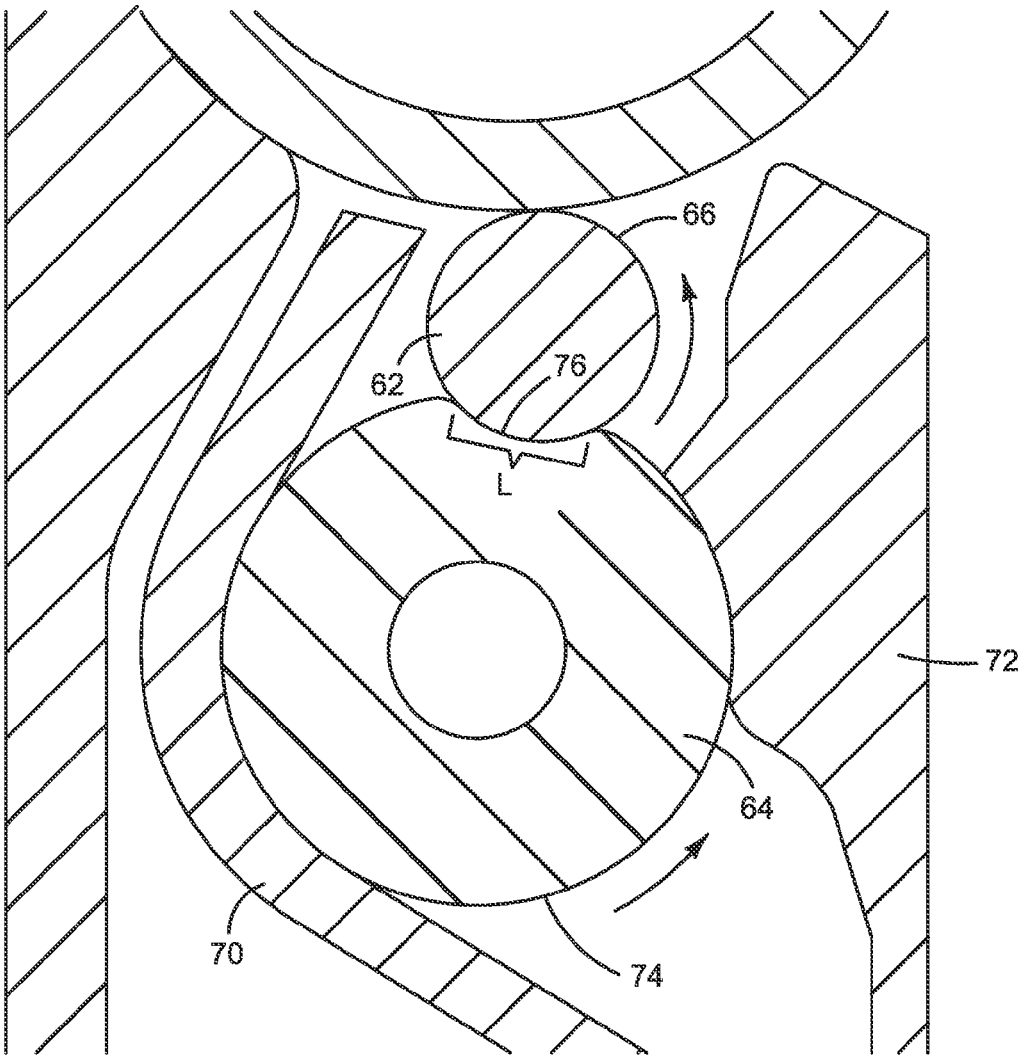
FIG. 3 is a detail view illustrating the contact region between the sponge roller and the cleaning roller in the image developer of FIG. 2.

Referring now also to FIG. 3, sponge roller 64 includes a deformable outer part 74. The density of complaint outer part 74 in combination with the contact region 76 between sponge roller 64 and cleaning roller 62 are adjusted to achieve the desired scrubbing affect on cleaning roller outer surface 66. Sponge roller 64 should be sufficiently abrasive on cleaning roller 62 to remove the desired amount of ink residue from cleaning roller 62 without adversely affecting print quality, such as can happen with a wiper blade. The desired sponge roller 64 may be characterized by (1) the density of outer part 74 and (2) the ratio of the arc length L (in cross section) of contact between sponge roller 64 and cleaning roller 62 (indicated by L in FIG. 3) to the circumference $C_{CR}$ of cleaning roller 62. We have determined that a sponge roller 64 having an outer part density in the range of 90 kg/m$^3$ to 150 kg/m$^3$ and a compression ratio $L/C_{CR}$ in the range of 20% to 38% will effectively remove ink from cleaning roller 62 without a wiper blade. Suitably dense, abrasive materials for the compliant outer part 74 of sponge roller 64 include, for example, polyester-polyurethane open cell foams. Sponge roller 64 is also compressed against chamber wall 70 and cleaner wall 72 to help squeeze ink from sponge roller 64 so that unused/waste ink may drain to return chamber 46. The ratio of the total arc length of contact of sponge roller 64 (against cleaning roller 62 and walls 70 and 72) to the circumference $C_{SR}$ of the sponge roller 64 should be in the range of 34% to 92%.

Although the characteristics of cleaning roller outer surface 62 and the relative rotational speed of rollers 62 and 64 may also affect the cleaning effectiveness of sponge roller 64, the noted characteristics for sponge roller 64 should achieve acceptable cleaning under operating conditions typical for an LEP printer. For example, in a typical LEP printing environment utilizing a 10 mm diameter steel cleaning roller 62, a 22.75 mm to 30 mm diameter sponge roller 64 having a density in the range of 90 kg/m$^3$ to 150 kg/m$^3$ deformed 1 mm to 5 mm (measured radially) at contact region 76 will effectively remove ink from cleaning roller 62 without a wiper blade. In this example, the un-deformed thickness of sponge roller outer part 76 is 6.375 mm to 10 mm and the rollers 62 and 64 rotate relative to one another such that the surface speed of sponge roller 64 relative to cleaning roller 62 is in the range of 2 m/s to 6 m/s. In a more specific example embodiment in which a new sponge roller is used without a wiper blade and without a squeezer roller in an otherwise conventional developer roller cleaner, a 25 mm diameter sponge roller 64 having an outer part density of about 90 kg/m$^3$ is located relative to the 10 mm diameter steel cleaning roller 62 so that sponge roller 64 deforms about 2.5 mm at contact region 76. During operation, cleaning roller 62 is rotated at about 3,920 rpm and sponge roller 64 is rotated against roller 62 at about 735 rpm.

Despite the seemingly small differences in the characteristics of the old and new sponge rollers, the new sponge roller 64 will achieve acceptable levels of ink removal while eliminating the scratching caused by the wiper blade. And, the new cleaner 52 may be operated effectively at a lower torque than the conventional cleaner, thus allowing the use of a smaller motor with reduced power consumption. Of course, one primary advantage of the new cleaner is its simplicity—instead of trying to optimize the wiper blade, we have removed the source of the problem and compensated by optimizing the sponge roller which, we have discovered, is a much less sensitive component. Significant cost savings may be realized in the image developer, which is a replaceable "consumable" component in the LEP printer, both by saving the cost of the wiper blade and by increasing the useful life of the image developer.

As noted at the beginning of this Description, the exemplary embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. An image developer, comprising:

a developer roller rotatable along a photoconductor for presenting a layer of ink to the photoconductor;

a cleaner for cleaning ink from the developer roller, the cleaner including:

a first cleaning roller rotatable along the developer roller for removing ink from the developer roller; and a second cleaning roller rotatable against the first cleaning roller, the second cleaning roller including a deformable outer part having a density in the range of 90 kg/m$^3$ to 150 kg/m$^3$ that deforms against the first cleaning roller for mechanically removing ink from the first cleaning roller; and the cleaner does not include a wiper blade for wiping ink from the developer roller.

2. The developer of claim 1, wherein:

the developer roller comprises an electrically chargeable developer roller; and the first cleaning roller comprises an electrically chargeable first cleaning roller for electrically removing ink from the developer roller.

3. The developer of claim 2, wherein the second cleaning roller deforms against the first cleaning roller such that the cross-sectional length of contact between the first and second cleaning rollers is in the range of 20% to 38% of the circumference of the first cleaning roller.

4. The developer of claim 1, wherein the first and second cleaning rollers, when rotated, move in opposite directions at the contact area.

5. An image developer, comprising:

an electrically chargeable developer roller rotatable along a photoconductor for presenting a layer of ink to the photoconductor;

an electrically chargeable cleaning roller rotatable along the developer roller for electrically removing ink from the developer roller; and a sponge roller rotatable against the cleaning roller for mechanically removing ink from the cleaning roller, the sponge roller having a deformable outer part with a density in the range of 90 kg/m$^3$ to 150 kg/m$^3$ that deforms against the cleaning roller such that the cross-sectional length of contact between the cleaning roller and the sponge roller is in the range of 20% to 38% of the circumference of the cleaning roller.

6. An image developer, comprising:

a developer roller rotatable along a photoconductor for presenting a layer of ink to the photoconductor;

a first cleaning roller rotatable along the developer roller for removing ink from the developer roller; and a deformable second cleaning roller rotatable against the first cleaning roller for removing ink from the first cleaning roller, the second cleaning roller having an outside diameter in the range of 22.75 mm to 30 mm and a density in the range of 90 kg/m$^3$ to 150 kg/m$^3$, and the second cleaning roller positioned relative to the first cleaning roller such that, when the second cleaning roller is rotated against the first cleaning roller, the second cleaning roller is deformed in the range of 1 mm to 5 mm, measured radially, at a region of contact between the first and second cleaning rollers.

7. The developer of claim 6, wherein:

the developer roller comprises an electrically chargeable developer roller;

the first cleaning roller comprises an electrically chargeable first cleaning roller for electrically removing ink from the developer roller; and the second cleaning roller deforms against the first cleaning roller such that, when the second cleaning roller is rotated against the first cleaning roller, the cross-sectional length of contact between the first and second cleaning rollers is in the range of 20% to 38% of the circumference of the first cleaning roller.

8. The developer of claim 6, wherein the first and second cleaning rollers, when rotated, move in opposite directions at the contact area.

9. The developer of claim 8, wherein the surface speed of the second cleaning roller relative to the first cleaning roller at the contact region is in the range of 2 m/s to 6 m/s.

* * * * *